US011274463B2

(12) United States Patent
Tsuto

(10) Patent No.: US 11,274,463 B2
(45) Date of Patent: Mar. 15, 2022

(54) FLOOR STRUCTURE

(71) Applicant: FUJIFILM Business Innovation Corp., Tokyo (JP)

(72) Inventor: Satoru Tsuto, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/718,188

(22) Filed: Dec. 18, 2019

(65) Prior Publication Data

US 2020/0318374 A1 Oct. 8, 2020

(30) Foreign Application Priority Data

Apr. 4, 2019 (JP) ..... JP2019-071742

(51) Int. Cl.
*E04H 9/02* (2006.01)
*E04H 1/12* (2006.01)

(52) U.S. Cl.
CPC ..... *E04H 9/029* (2013.01); *E04H 1/125* (2013.01)

(58) Field of Classification Search
CPC ..... E04F 15/02464; E04F 15/0247; E04F 15/02476; E04F 15/02482; E04F 15/02194; E04F 15/02411; E04F 15/02417; E04F 15/02458; E04H 9/029; E04H 1/125; E04H 1/1205; E04H 1/12; E04H 1/1261; E04B 1/40; E04B 1/34384; E04B 1/34861; E04B 1/34315
See application file for complete search history.

(56) References Cited

U.S. PATENT DOCUMENTS 3,324,614 A * 6/1967 Loewenau ..... E04F 15/0247 52/126.6
4,852,315 A * 8/1989 Fukayama ..... H02G 3/285 52/220.3
RE33,220 E * 5/1990 Collier ..... E04F 15/02452 174/490
5,467,609 A * 11/1995 Feeney ..... E04F 15/02411 52/220.2
5,791,096 A * 8/1998 Chen ..... E04F 15/02458 52/126.6
5,927,030 A * 7/1999 Petit ..... H02G 3/285 52/220.1
6,202,374 B1 * 3/2001 Cooper ..... E04B 5/48 52/126.3
6,637,161 B1 * 10/2003 Buchalter ..... E04F 15/02447 52/126.6

(Continued)

FOREIGN PATENT DOCUMENTS

JP 2004150255 5/2004
JP 2018178511 11/2018

*Primary Examiner* — Theodore V Adamos
(74) *Attorney, Agent, or Firm* — JCIPRNET

(57) ABSTRACT

There is provided a floor structure for a booth that is installed on an installation surface and that includes a side wall and a door through which a user enters and exits the booth. The floor structure includes a floor surface of a space that is enclosed by the side wall and in which a desk and a chair are placed on the floor surface and a fastener that fastens the floor surface to the installation surface and that is provided so as to be accessible. The floor surface is divided, outside a range of motion of the chair, into portions including a removable portion.

8 Claims, 12 Drawing Sheets

(56) References Cited

U.S. PATENT DOCUMENTS

| | | | | |
|---|---|---|---|---|
| 6,748,707 | B1 * | 6/2004 | Buchalter | E04F 15/024 439/131 |
| 2004/0003545 | A1 * | 1/2004 | Gillespie | E04H 1/125 52/36.1 |
| 2008/0026688 | A1 * | 1/2008 | Musick | B08B 1/00 454/187 |
| 2008/0263968 | A1 * | 10/2008 | Day | E04B 1/34321 52/79.1 |
| 2010/0281789 | A1 * | 11/2010 | Vac | E04F 15/02458 52/126.5 |
| 2011/0302854 | A1 * | 12/2011 | Armijo | E04F 15/02464 52/126.6 |
| 2012/0304549 | A1 * | 12/2012 | Rutledge | E04D 13/064 52/16 |
| 2013/0104464 | A1 * | 5/2013 | Meyer | E04F 15/02458 52/126.6 |
| 2014/0123576 | A1 * | 5/2014 | Meyer | E04F 15/02452 52/126.6 |
| 2018/0291614 | A1 * | 10/2018 | Evert | E04H 9/14 |
| 2020/0018060 | A1 * | 1/2020 | Watanabe | E04B 1/34846 |

* cited by examiner

FLOOR STRUCTURE

CROSS-REFERENCE TO RELATED APPLICATIONS

This application is based on and claims priority under 35 USC 119 from Japanese Patent Application No. 2019-071742 filed Apr. 4, 2019.

BACKGROUND

(i) Technical Field

The present disclosure relates to a floor structure.

(ii) Related Art

A private box-type room configured of a top panel, a floor panel, and wall panels in all directions (front, back, left, and right), with each panel formed of a lightweight panel is known. The panels are joinable to each other by nuts and bolts to form a joined structure that can be assembled and disassembled in a flexible manner. The private box-type room is equipped with at least a table portion and a single chair to be used with the table portion inside the private box-type room (Japanese Unexamined Patent Application Publication No. 2004-150255).

An installation structure of an earthquake-resistant shelter, which is a structure in which the earthquake-resistant shelter is assembled inside an existing building, is also known. The installation structure of the earthquake-resistant shelter includes a foundation portion of the earthquake-resistant shelter disposed on an existing floor of the existing building, a floor board of the earthquake-resistant shelter disposed on the foundation portion, pillar-integrated wall panels of the earthquake-resistant shelter disposed on the foundation portion in an upright manner, a top panel of the earthquake-resistant shelter disposed on an upper side of the pillar-integrated wall panels, and dry floor posts positioned under the existing floor and below the foundation portion (Japanese Unexamined Patent Application Publication No. 2018-178511).

SUMMARY

Aspects of non-limiting embodiments of the present disclosure relate to providing a floor structure in which a fastener fastening a booth, which houses a desk and a chair, to an installation surface is accessible from inside the booth.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a floor structure for a booth that is installed on an installation surface and that includes a side wall and a door through which a user enters and exits the booth. The floor structure includes a floor surface of a space that is enclosed by the side wall and in which a desk and a chair are placed on the floor surface and a fastener that fastens the floor surface to the installation surface and that is provided so as to be accessible. The floor surface is divided, outside a range of motion of the chair, into portions including a removable portion.

BRIEF DESCRIPTION OF THE DRAWINGS

Exemplary embodiments of the present disclosure will be described in detail based on the following figures, wherein.

DETAILED DESCRIPTION

With reference to the drawings, the present disclosure will be described in further detail by providing exemplary embodiments and specific examples hereinafter. However, the present disclosure is not limited to these exemplary embodiments and specific examples.

In the description with reference to the following drawings, the drawings are schematic. Thus, it should be noted that the ratios or the like of dimensions differ from actual ratios, and illustrations of unnecessary portions for the description are omitted as appropriate for facilitating understanding.

First Exemplary Embodiment (1) Overall Structure of Booth

Figure 1:
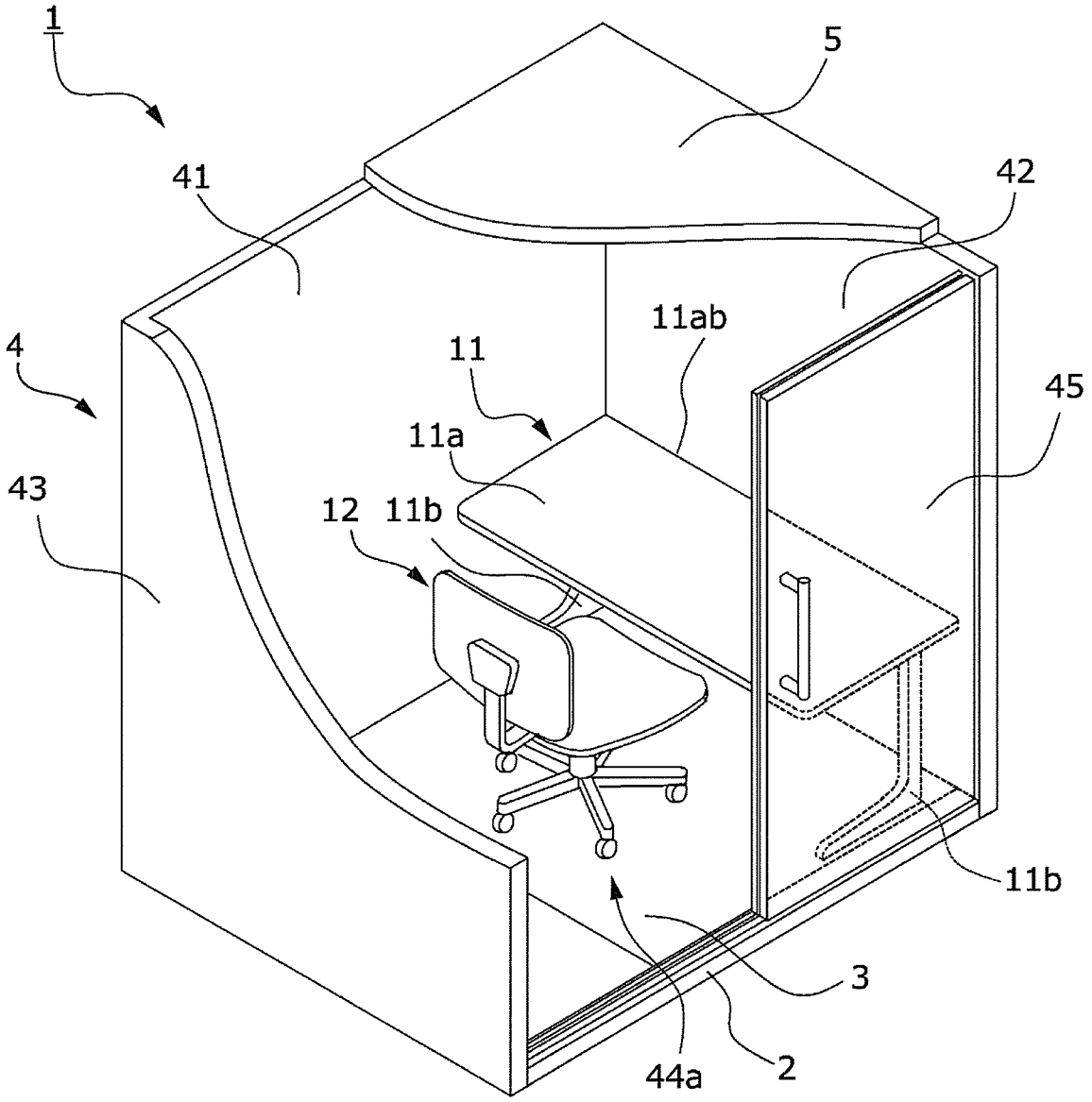
FIG. 1 is a partially cutaway perspective view of an inner configuration of a booth according to a first exemplary embodiment.
Figure 2:
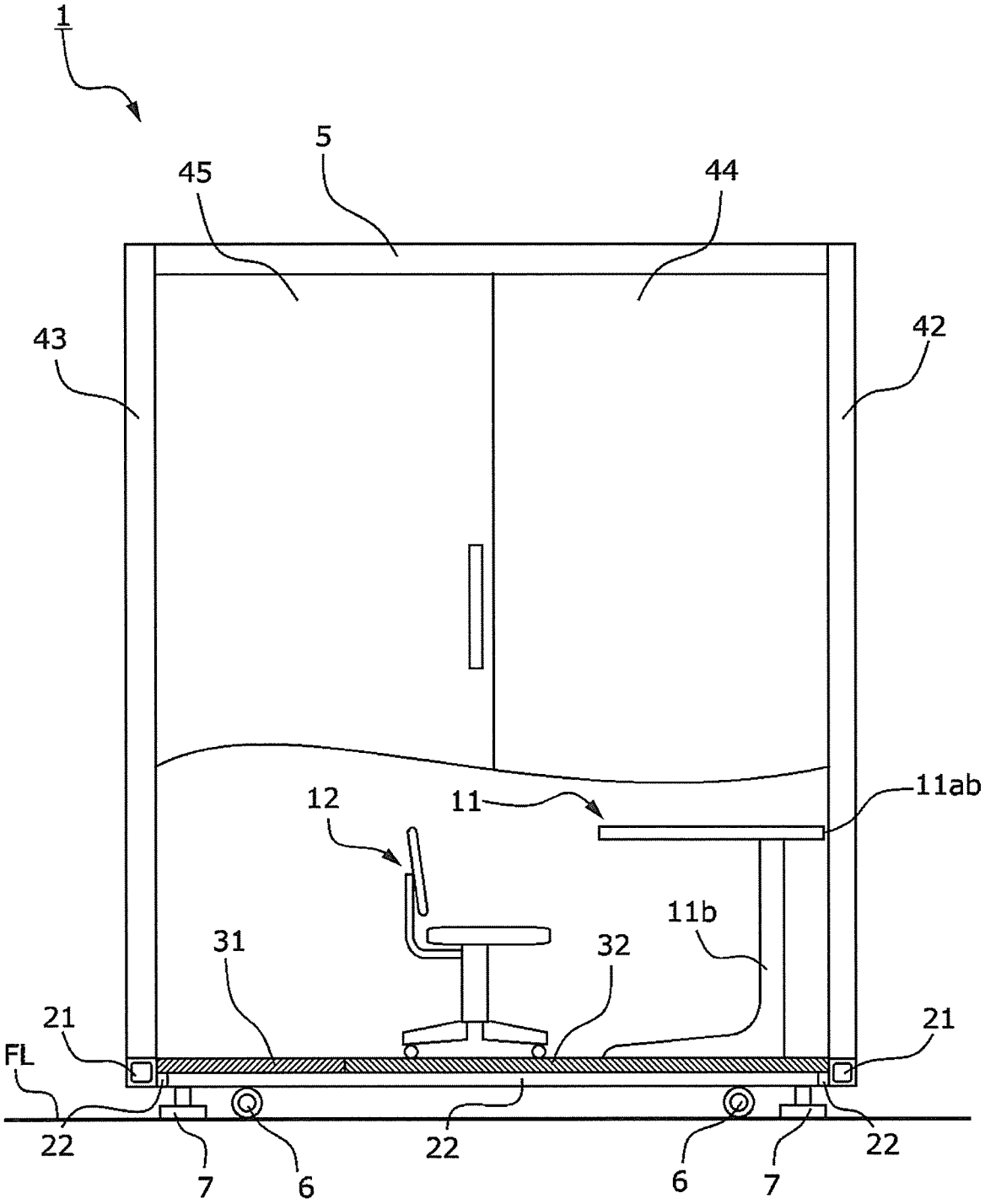
FIG. 2 is a partially sectional front view of the inner configuration of the booth.

FIG. 1 is a partially cutaway perspective view of an inner configuration of a booth 1 according to the present exemplary embodiment. FIG. 2 is a partially sectional front view of the inner configuration of the booth 1. Hereinafter, the overall structure of the booth 1 will be described with reference to the figures.

As illustrated in FIGS. 1 and 2, the booth 1 includes a foundation portion 2 disposed above an installation surface FL, a floor board 3 disposed on the foundation portion 2, a side-wall panel 4 disposed on the foundation portion 2 in an upright manner, a top panel 5 disposed on the side-wall panel 4, four casters 6 disposed at a lower portion of the foundation portion 2, and four fasteners 7 disposed at a lower portion of the foundation portion 2 and near the respective casters 6.

The foundation portion 2 is formed by joining four beam members 21 to each other so as to form a rectangular shape corresponding to a bottom shape of the booth 1, and the foundation portion 2 is formed of, for example, rectangular steel tubes.

The floor board 3 is in contact with and supported by a floor supporting member 22 protruding inward relative to the foundation portion 2. For example, the floor board 3 is formed of structural plywood, which is a wooden board member, on which a floor mat is layered.

The side-wall panel 4 is formed of a first side-wall panel 41 that forms a backside wall, a second side-wall panel 42 and a third side-wall panel 43 that form a right-side wall and a left-side wall, respectively, and a fourth side-wall panel 44 that forms a front-side wall. The fourth side-wall panel 44 has an opening 44*a* that is to be an entrance, and the opening 44*a* is fitted with a door 45. In the present exemplary embodiment, the door 45 is a sliding door.

The top panel 5 is fixed to an upper end portion of the side-wall panel 4 so as to close an upper opening formed by the side-wall panel 4, and the top panel 5 is formed of, for example, structural plywood that is a wooden board member. The upper opening formed by the side-wall panel 4 may remain open without installing the top panel 5.

The casters 6 are disposed at four corners of the lower portion of the foundation portion 2. When installing the booth 1, which has been assembled in a factory or the like, at an installation site, the booth 1 is transported by a truck or the like while placed on the truck bed and, at the installation site, the booth 1 is installed on the installation surface FL by moving the booth 1 on the casters 6.

The fasteners 7 are adjustable in height, and the booth 1 is immovably fixed to the installation surface FL in such a manner that, between the installation surface FL and the foundation portion 2, the casters 6 are suspended above the installation surface FL.

In the booth 1 configured as described above, a desk 11 and a chair 12 are placed as illustrated in FIG. 1 so that a user may work or study while sitting on the chair 12 and using the desk 11.

The desk 11 is formed of a top 11*a* and a pair of legs 11*b* supporting the top 11*a*. The top 11*a* is disposed above the floor board 3 in such a manner that a back-end edge 11*ab* of the top 11*a* is in contact with a side wall (the second side-wall panel 42) of the four side-wall panels 41, 42, 43, and 44.

In contrast, the chair 12 is movable on the floor board 3 within a predetermined range.

(2) Floor Structure

Figure 3A:
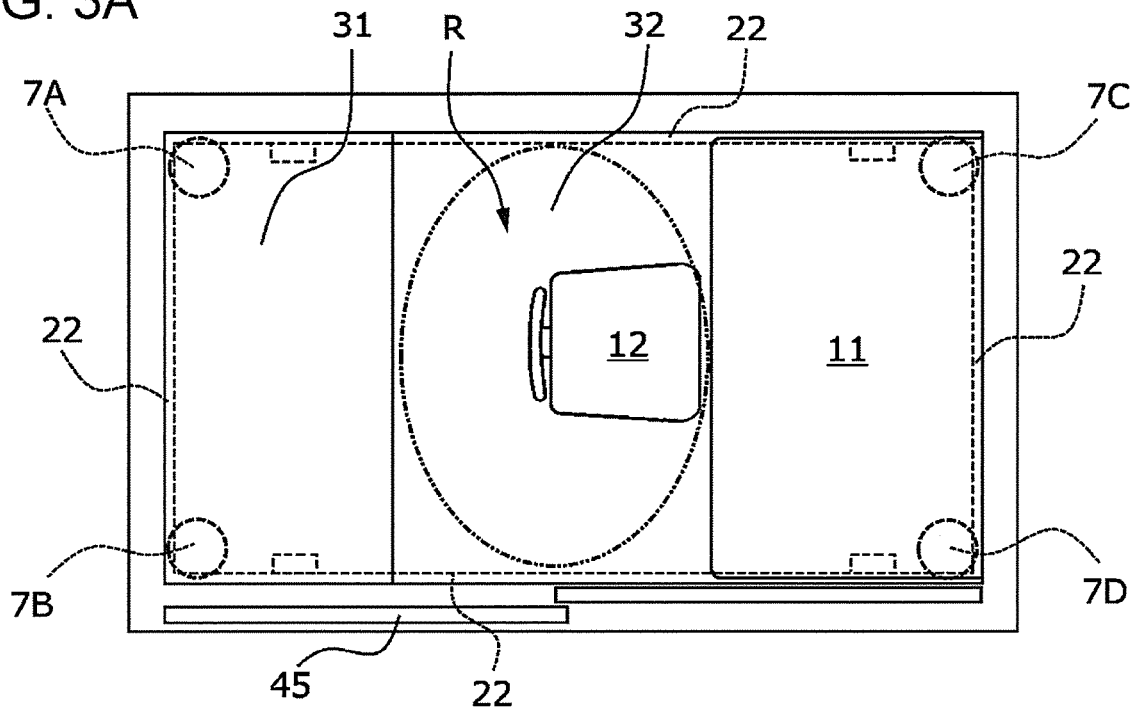
FIGS. 3A and 3B are a sectional plan view and a partial sectional front view, respectively, of the inner configuration of the booth.
Figure 3B:
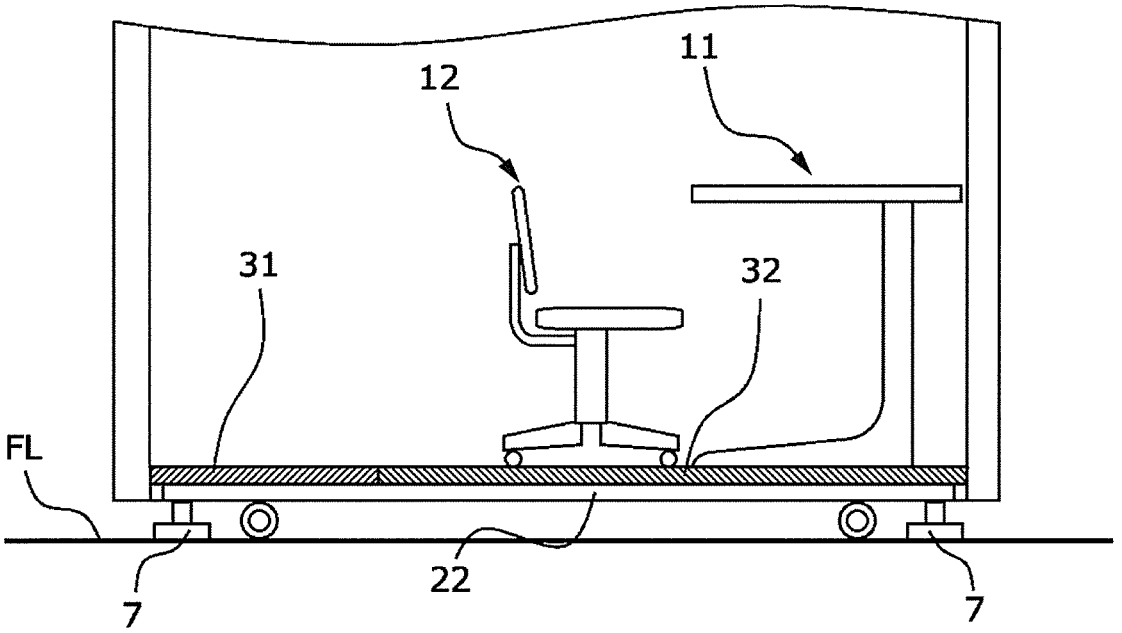
Figure 4A:
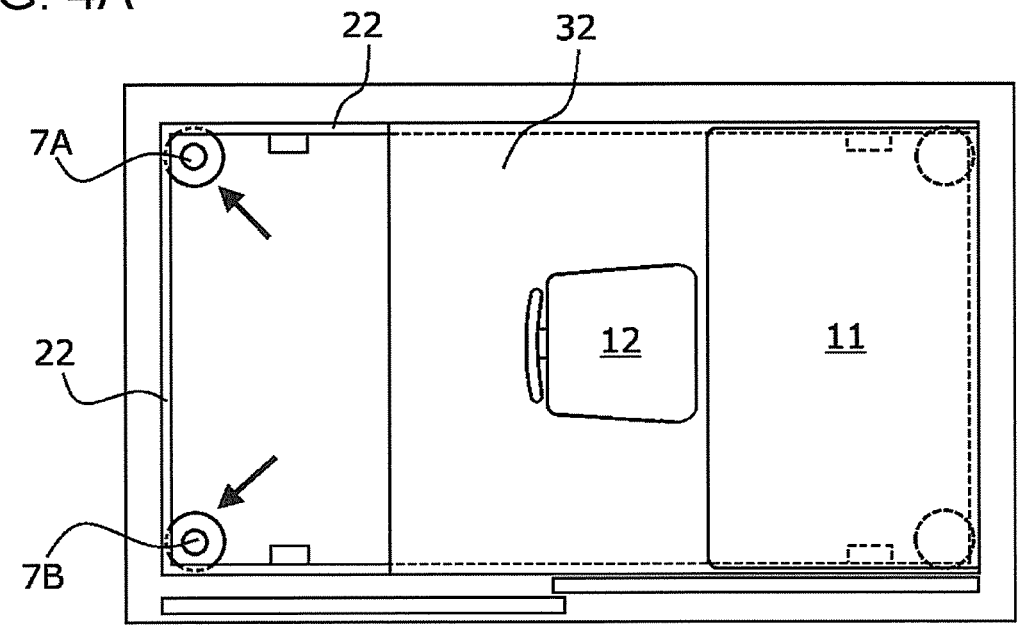
FIGS. 4A and 4B are a sectional plan view and a partial sectional front view, respectively, of the inner configuration of the booth in a state in which a smaller floor board of a floor board divided into two floor boards is removed.
Figure 4B:
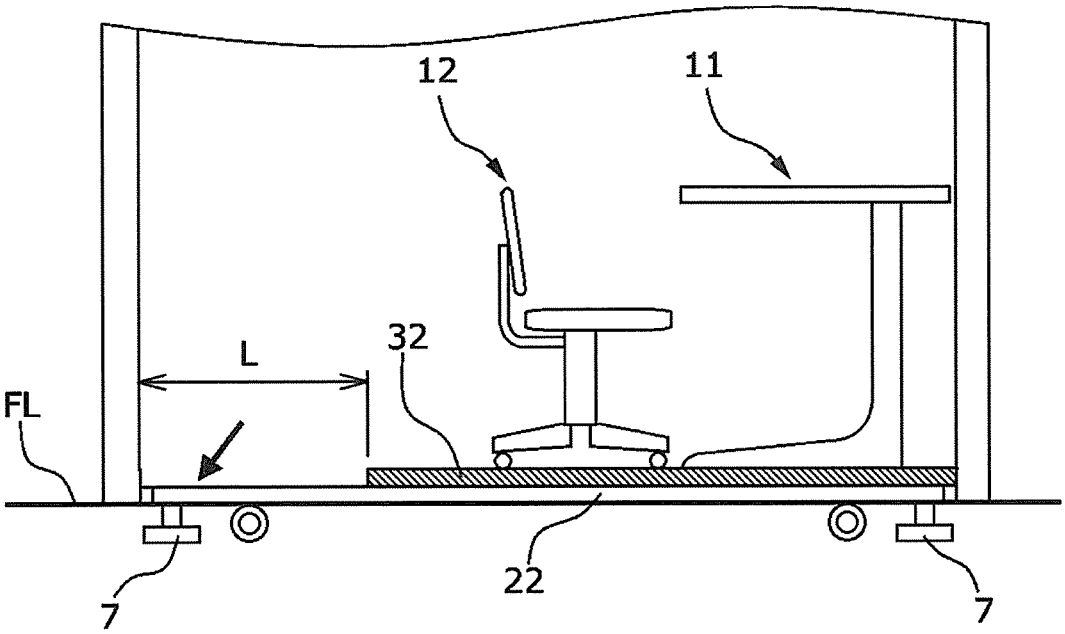
Figure 5A:
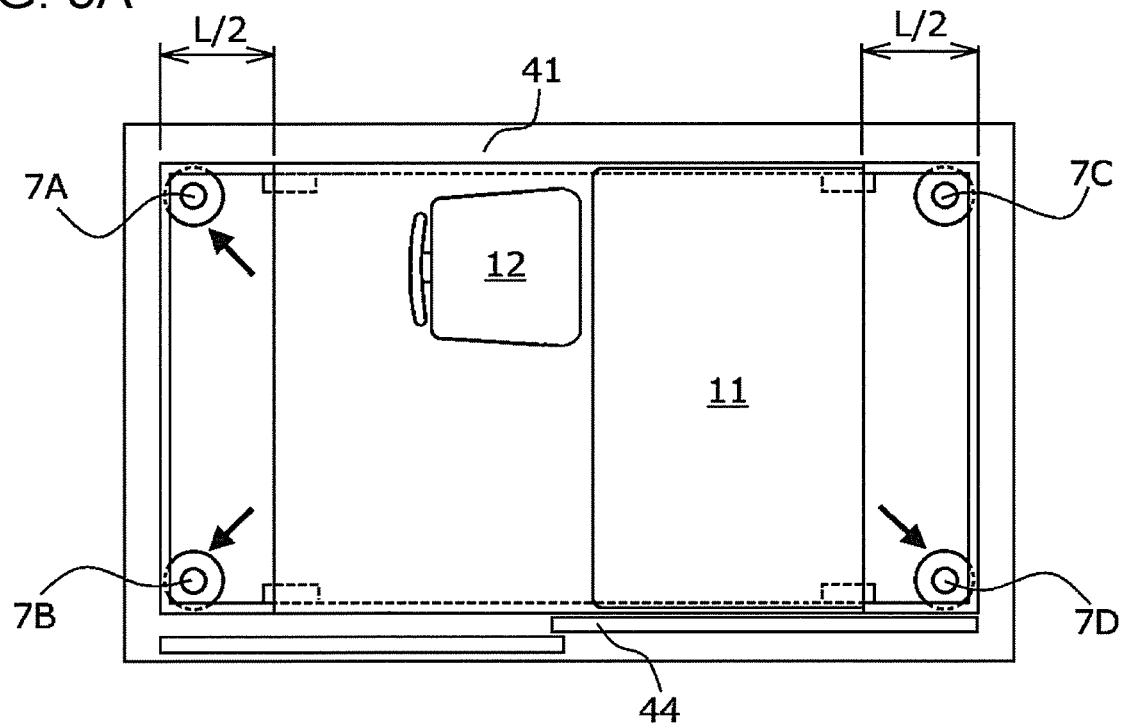
FIGS. 5A and 5B are sectional plan views of the inner configuration of the booth in a state in which the smaller floor board of the floor board divided into two floor boards is removed and the location of a larger floor board is changed.
Figure 5B:
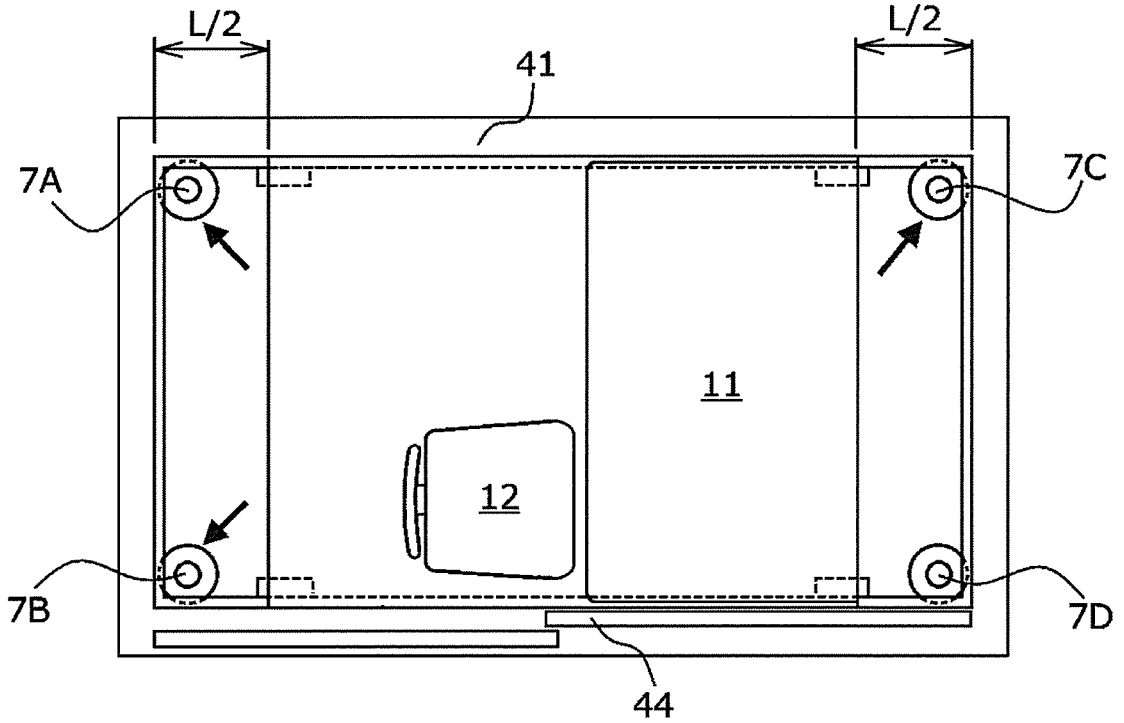

FIGS. 3A and 3B are a sectional plan view and a partial sectional front view, respectively, of the inner configuration of the booth 1. FIGS. 4A and 4B are a sectional plan view and a partial sectional front view, respectively, of the inner configuration of the booth 1 in a state in which a smaller floor board 31 of the floor board 3 divided into two floor boards is removed. FIGS. 5A and 5B are sectional plan views of the inner configuration of the booth 1 in a state in which the smaller floor board 31 of the floor board 3 divided into two floor boards is removed and the location of a larger floor board 32 is changed.

Hereinafter, a floor structure of the booth 1 will be described with reference to the figures.

As illustrated in FIGS. 3A and 3B, the floor board 3 is unequally divided into two floor boards that are the smaller floor board 31 and the larger floor board 32 arranged in the longitudinal direction of the floor surface. The smaller floor board 31 of the divided floor board 3 is removable. As illustrated in FIG. 3A, the floor board 3 is divided, outside a range of motion of the chair 12, into the smaller floor board 31 and the larger floor board 32 (see Region R enclosed by a chain double-dashed line in FIG. 3A).

As illustrated in FIGS. 4A and 4B, two fasteners 7A and 7B of the four fasteners 7 disposed at the lower portion the foundation portion 2 and near the respective casters 6 become accessible from inside the booth 1 (see arrows in FIGS. 4A and 4B) when the smaller floor board 31 of the floor board 3 divided into two floor boards as described above is removed.

In addition, in the floor surface, a space enabling the remaining larger floor board 32 to move in the longitudinal direction of the floor surface is created (see L in FIG. 4B). In this state, the desk 11 and the chair 12 are placed on the larger floor board 32. The smaller floor board 31 to be removed is positioned close to the door 45. Thus, the fasteners 7 are accessible from inside the booth 1 without removing the desk 11 and the chair 12 from the booth 1.

As illustrated in FIGS. 5A and 5B, the other fasteners 7C and 7D also become accessible from inside the booth 1 when the larger floor board 32 is moved to the space created by removing the smaller floor board 31, by a distance of substantially half the length (L/2) of the space in the longitudinal direction of the floor board 3, while the desk 11 and the chair 12 remain placed on the larger floor board 32.

In this state, the chair 12 may be moved toward the first side-wall panel 41 (see FIG. 5A) or toward the fourth side-wall panel 44 (see FIG. 5B) on the larger floor board 32, and each of the fasteners 7C and 7D may be easily accessed from inside the booth 1 without removing the desk 11 and the chair 12 from the booth 1.

The larger floor board 32 that has been moved to the space created by removing the smaller floor board 31, even at the position of the larger floor board 32 after being moved to the space, is in contact with and supported by the floor supporting member 22 protruding inward relative to the foundation portion 2. Thus, sagging of the floor surface is suppressed.

The fasteners 7 may be known adjusters. The installation height of the booth 1 from the installation surface FL is vertically adjustable by accessing each of the fasteners 7 from an access space, which is created by changing the location of the larger floor board 32, and by rotating an adjustment bolt 7*a* of each of the fasteners 7 (see FIG. 12).

Modifications

Figure 6A:
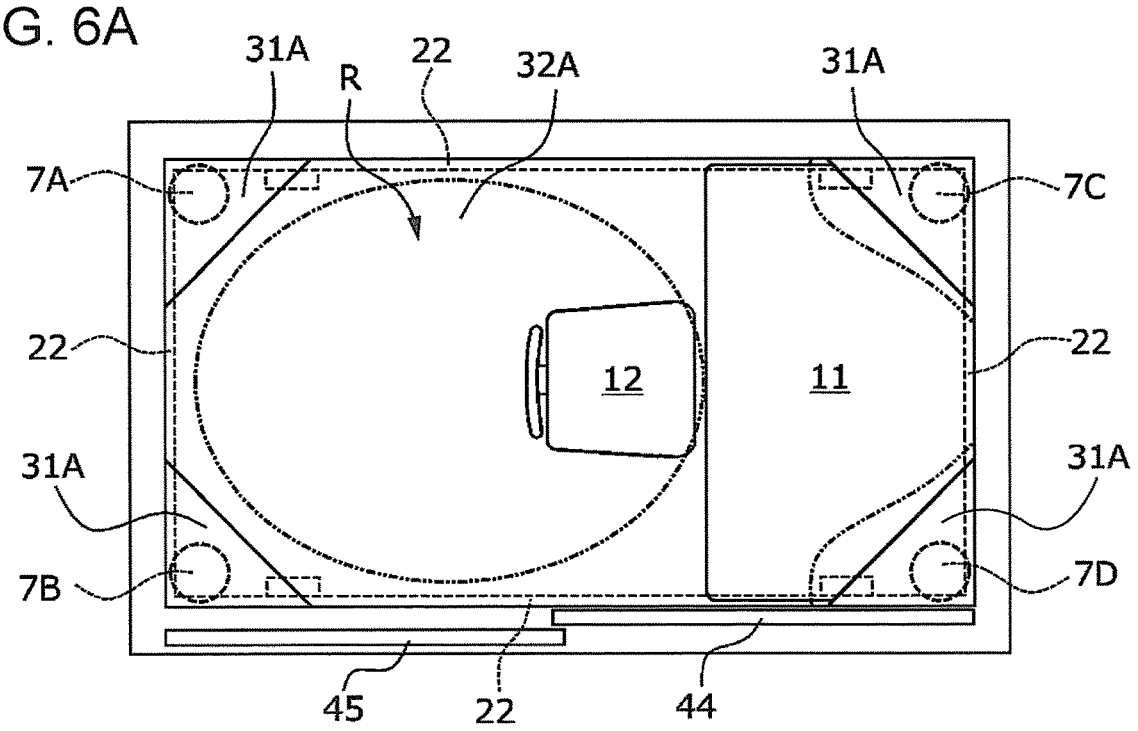
FIGS. 6A and 6B are a sectional plan view and a partial sectional front view, respectively, of an inner configuration of a booth according to a modification.
Figure 6B:
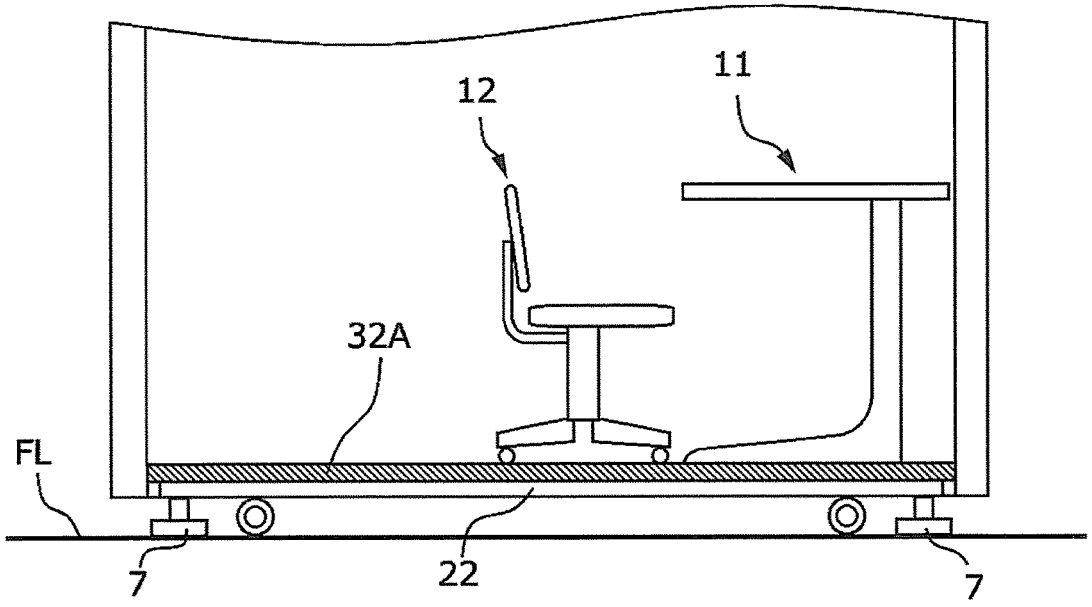
Figure 7A:
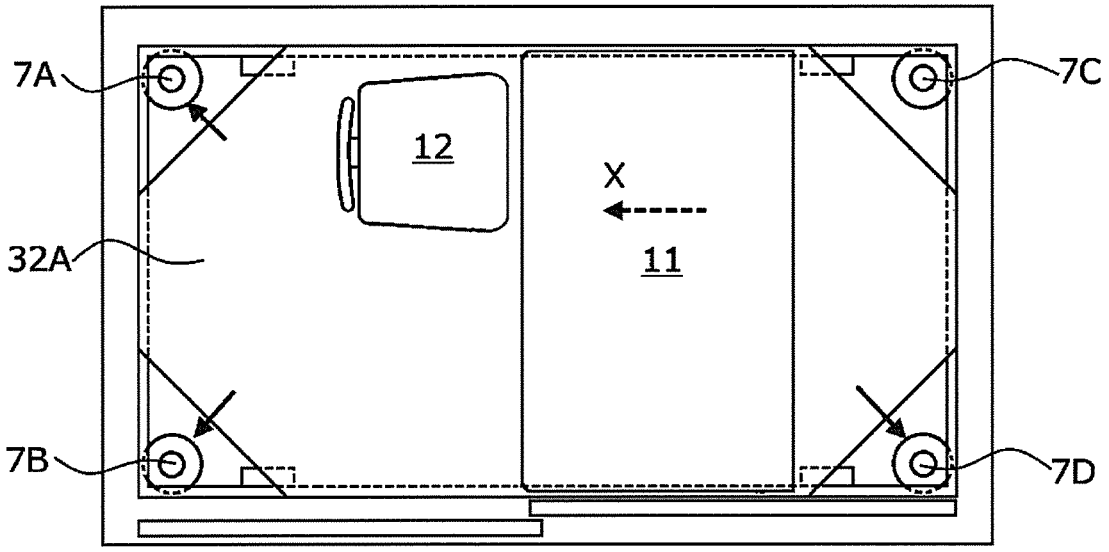
FIGS. 7A and 7B are sectional plan views of the inner configuration of the booth in a state in which smaller floor boards of a floor board divided into two types of floor boards are removed and the locations of a desk and a chair are changed.
Figure 7B:
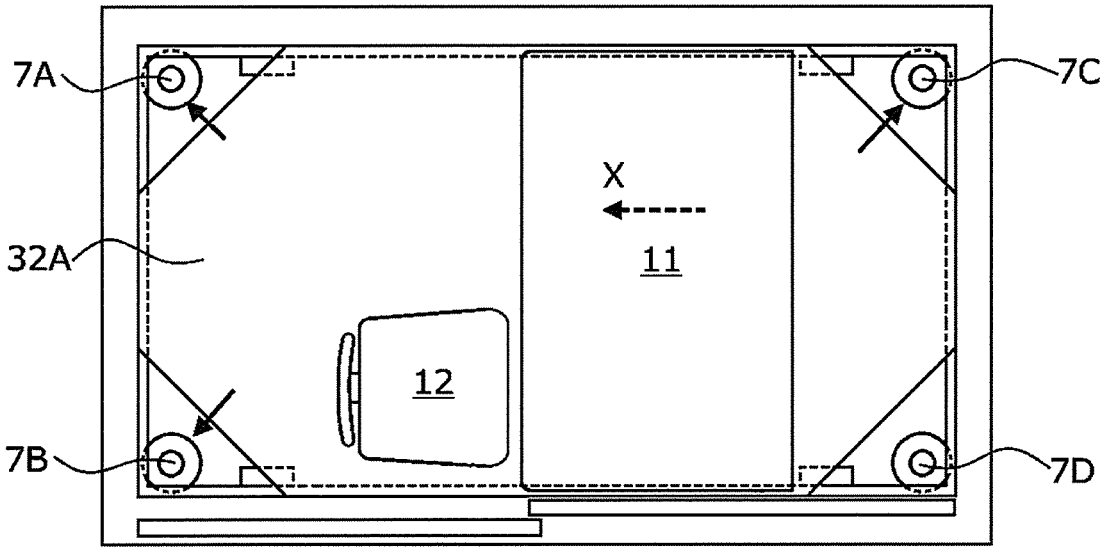

FIGS. 6A and 6B are a sectional plan view and a partial sectional front view, respectively, of an inner configuration of a booth 1 according to a modification. FIGS. 7A and 7B are sectional plan views of the inner configuration of the booth 1 in a state in which smaller floor boards 31A of a floor board 3A divided into two types of floor boards are removed and the locations of the desk 11 and the chair 12 are changed.

Figure 8A:
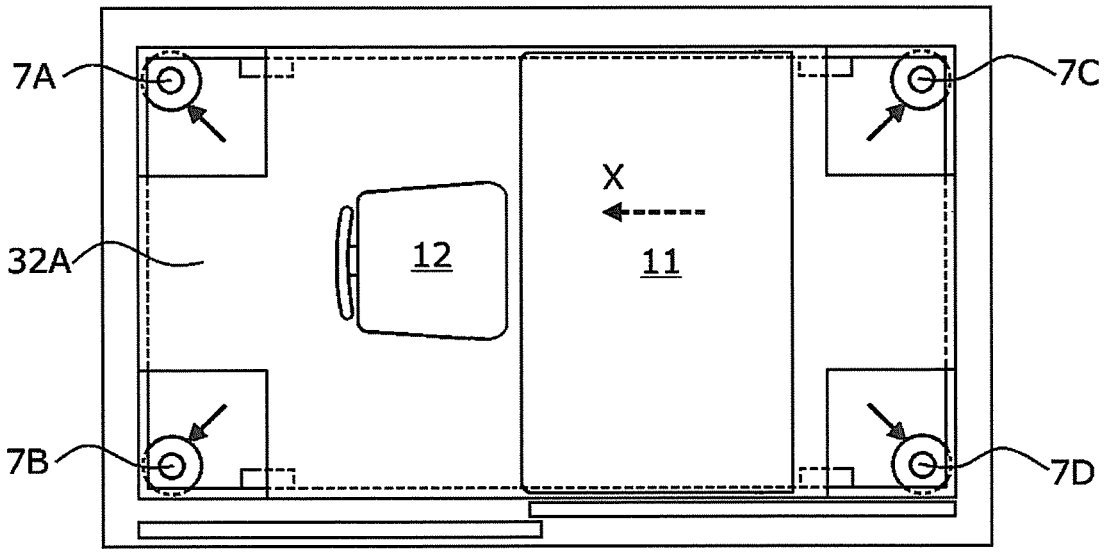
FIGS. 8A and 8B are sectional plan views of other examples of division of a floor board of a booth according to modifications.
Figure 8B:
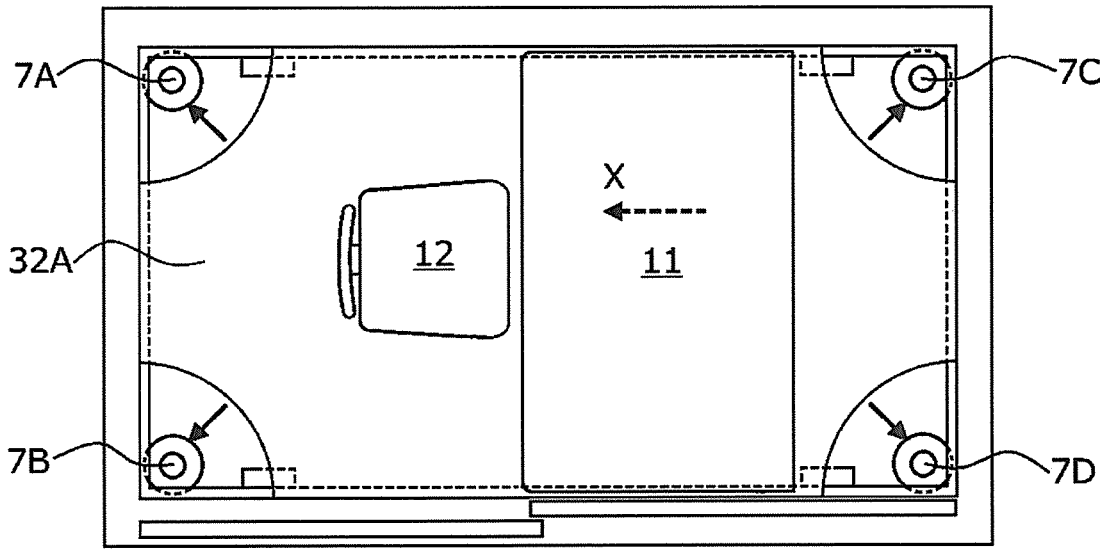

FIGS. 8A and 8B are sectional plan views of other examples of division of the floor board 3A of the booth 1 according to modifications.

As illustrated in FIGS. 6A and 6B, the floor board 3A of the booth 1 according to a modification is divided, outside the range of motion of the chair 12 (see Region R enclosed by a chain double-dashed line in FIG. 6A), into a larger floor board 32A and the triangular smaller floor boards 31A at four corners of the floor board 3A. The smaller floor boards 31A are removable.

The desk 11 and the chair 12 are placed on the larger floor board 32A. Four sides of the larger floor board 32A are in contact with and supported by the floor supporting member 22 protruding inward relative to the foundation portion 2. Thus, sagging of the floor surface is suppressed. Similarly, two sides of each of the triangular smaller floor boards 31A are in contact with and supported by the floor supporting member 22.

In the floor board 3A divided into portions as described above, mating surfaces (dividing positions) of the triangular smaller floor boards 31A and the octagonal larger floor board 32A are, as illustrated in FIGS. 6A and 6B, less likely to be positioned within the range of motion of the chair 12 (see Region R enclosed by a chain double-dashed line in FIG. 6A). Thus, sagging of the floor surface is suppressed.

As illustrated in FIGS. 7A and 7B, all four of the fasteners 7A, 7B, 7C, and 7D disposed at the lower portion of the foundation portion 2 and near the respective casters 6 become accessible from inside the booth 1 (see arrows in FIGS. 7A and 7B) when the smaller floor boards 31A of the floor board 3A divided into two types of floor boards are removed and the locations of the desk 11 and the chair 12 are changed on the larger floor board 32A (see Arrows X in FIGS. 7A and 7B), without removing the desk 11 and the chair 12 from the booth 1.

The shape of the smaller floor boards 31A that are formed by dividing the floor board 3A into portions at four corners of the floor surface is not limited to a triangular shape and may be a quadrangular shape as illustrated in FIG. 8A or a sectoral shape as illustrated in FIG. 8B.

All four of the fasteners 7A, 7B, 7C, and 7D become accessible from inside the booth 1 when the smaller floor boards 31A of the floor board 3A divided into two types of floor boards are removed and the locations of the desk 11 and the chair 12 are changed on the larger floor board 32A.

Second Exemplary Embodiment

Figure 9:
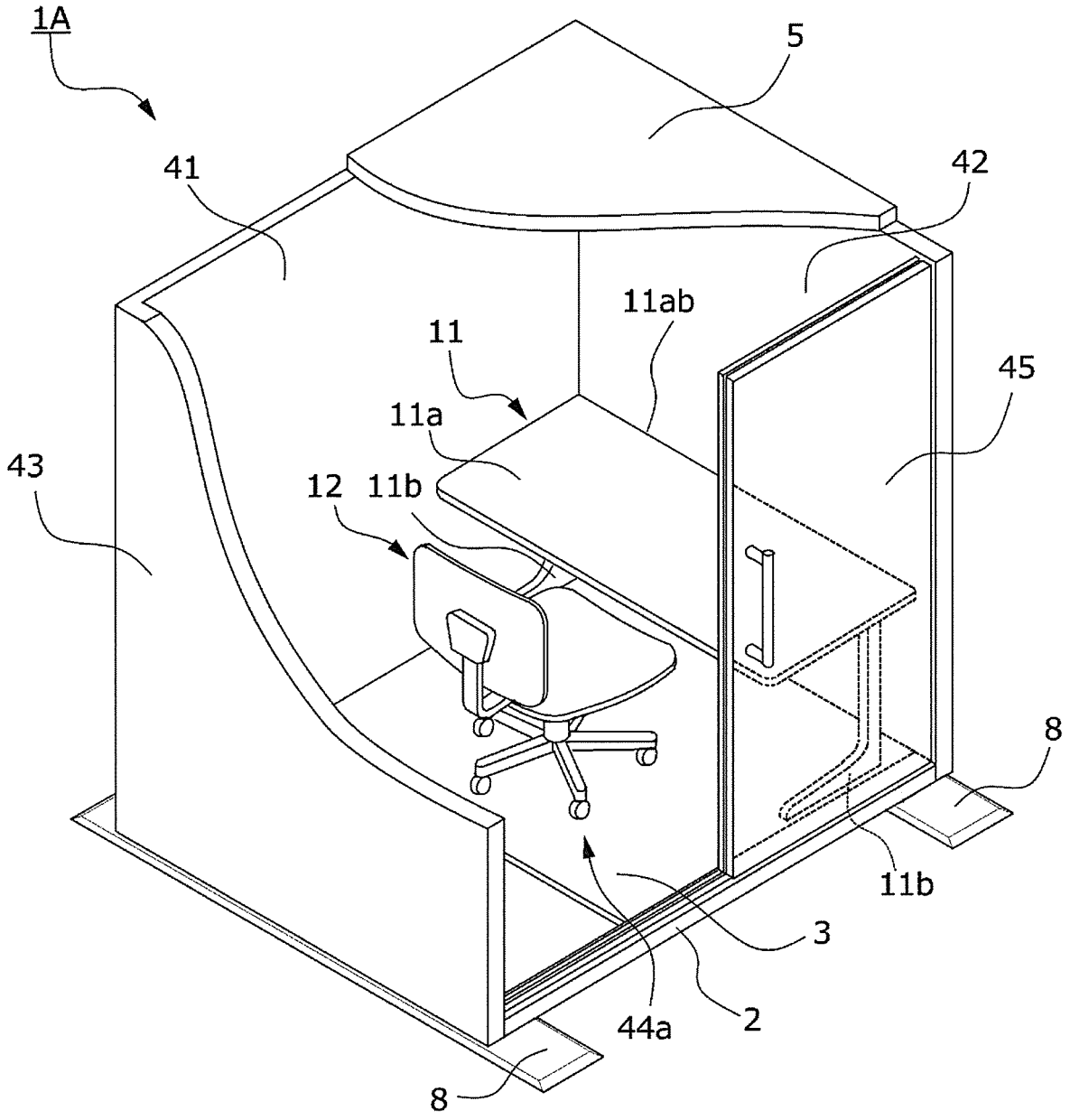
FIG. 9 is a partially cutaway perspective view of an inner configuration of a booth according to a second exemplary embodiment.
Figure 10A:
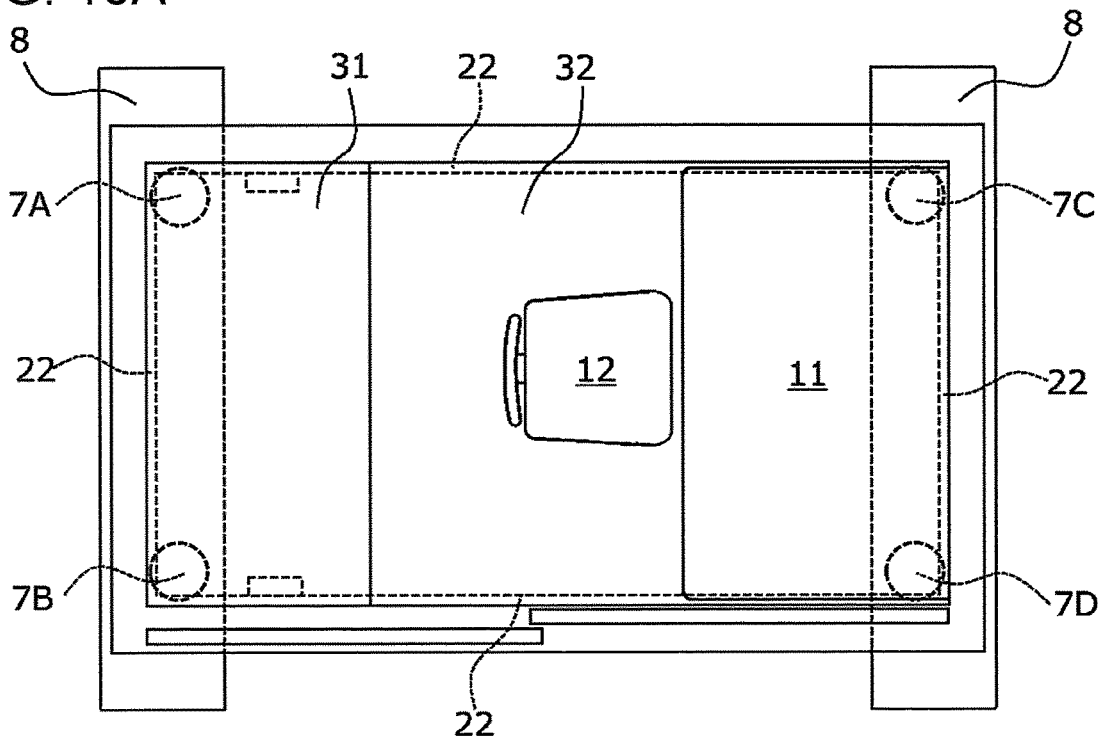
FIGS. 10A and 10B are a sectional plan view and a partial sectional front view, respectively, of the inner configuration of the booth.
Figure 10B:
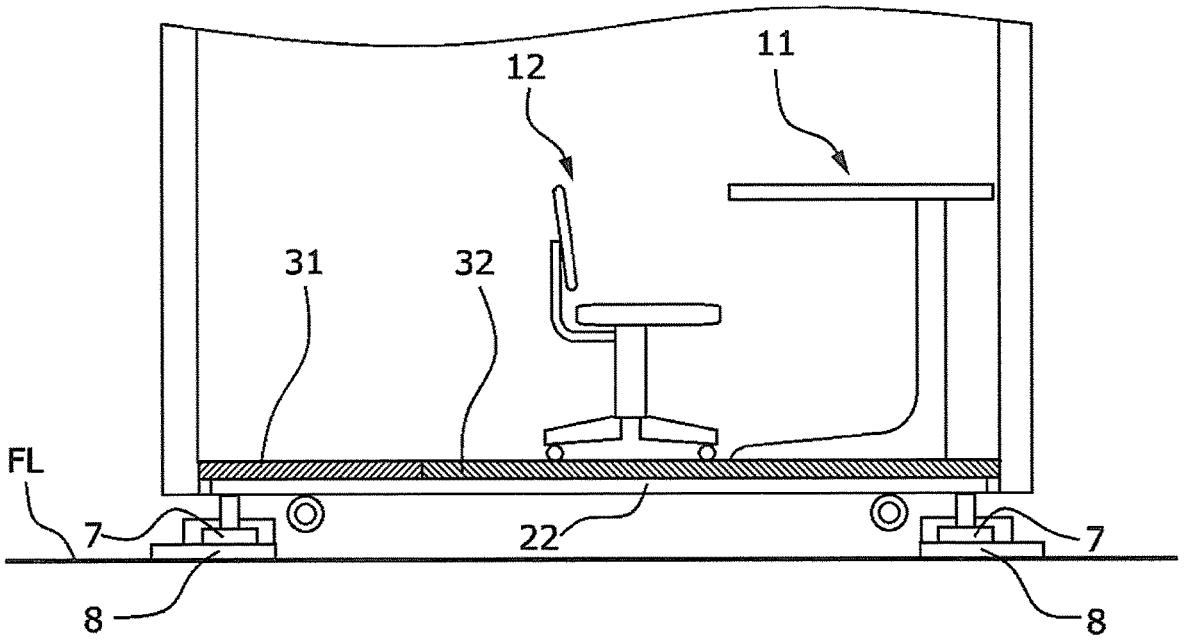
Figure 11A:
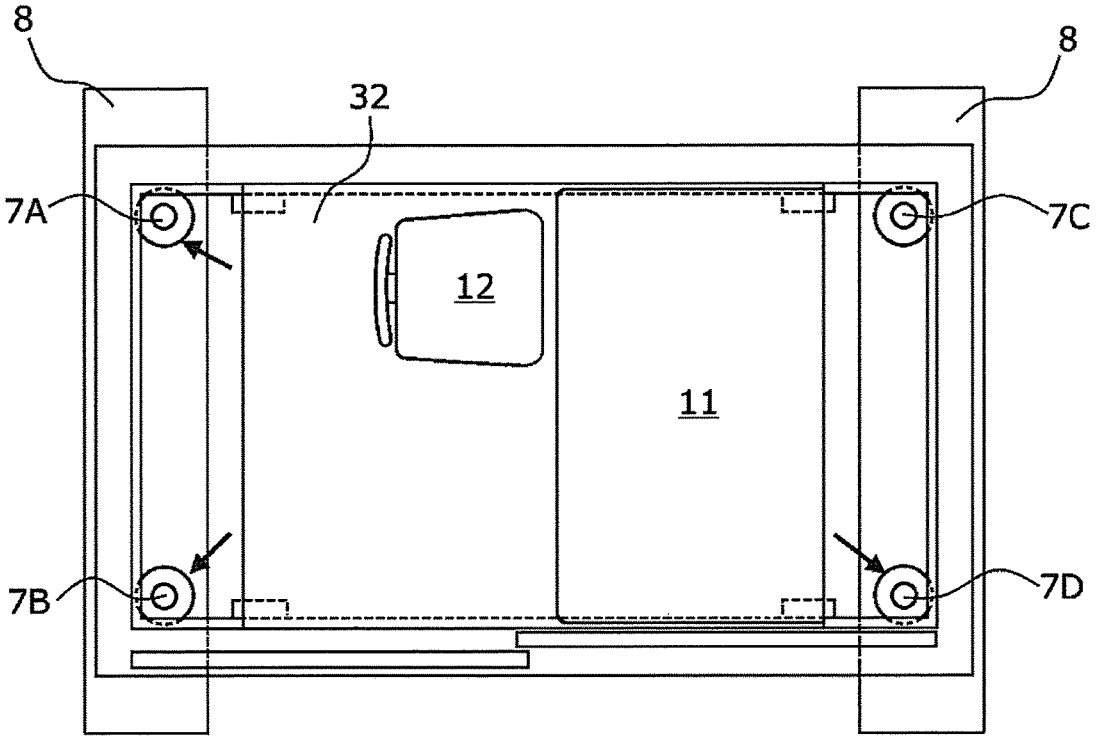
FIGS. 11A and 11B are sectional plan views of the inner configuration of the booth in a state in which a smaller floor board of a floor board divided into two floor boards is removed and the location of a larger floor board is changed.
Figure 11B:
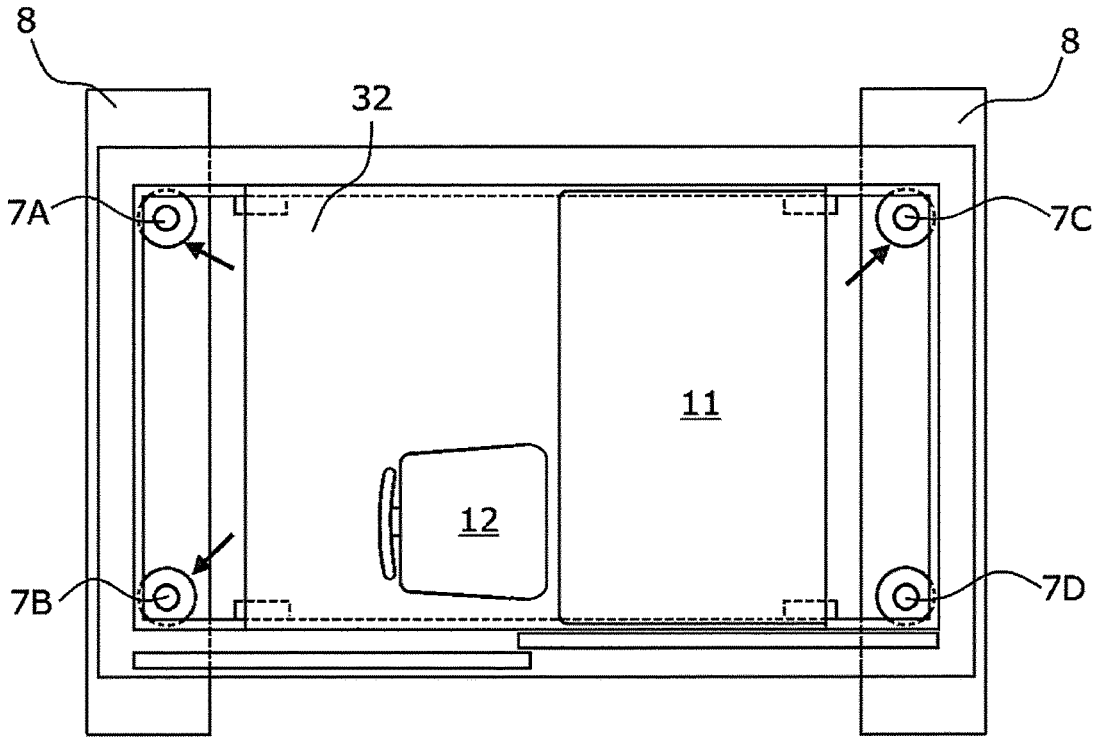
Figure 12:
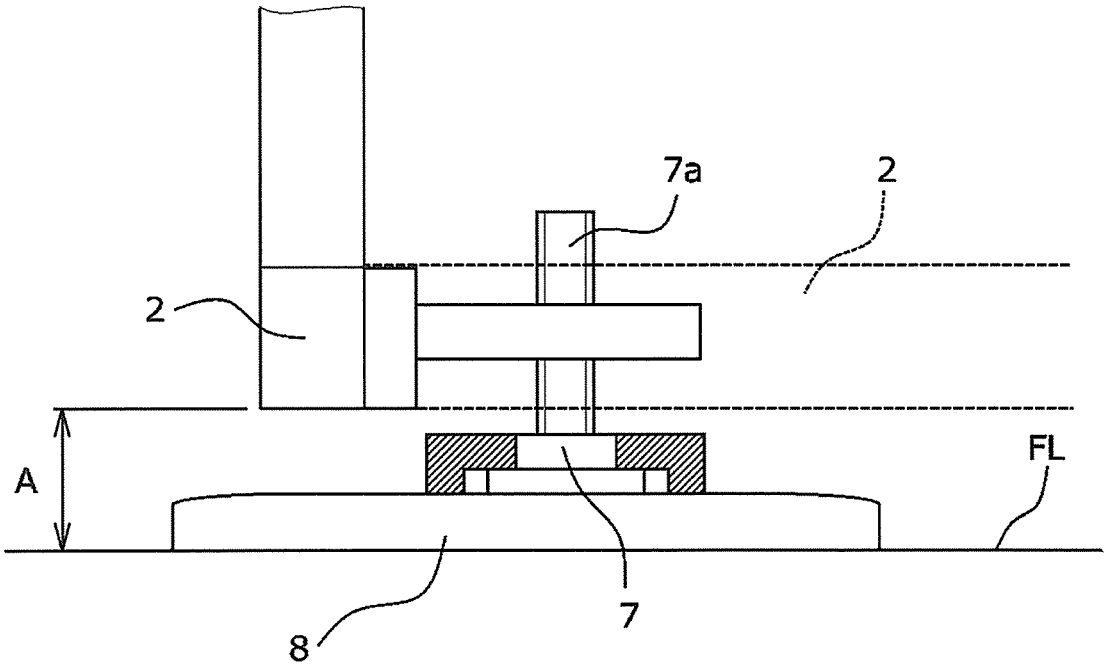
FIG. 12 illustrates installation of a fastener and an anti-toppling board.

FIG. 9 is a partially cutaway perspective view of an inner configuration of a booth 1A according to the present exemplary embodiment. FIGS. 10A and 10B are a sectional plan view and a partial sectional front view, respectively, of the inner configuration of the booth 1A. FIGS. 11A and 11B are sectional plan views of the inner configuration of the booth 1A in a state in which the smaller floor board 31 of the floor board 3 divided into two floor boards is removed and the location of the larger floor board 32 is changed. FIG. 12 illustrates installation of one of the fasteners 7 and a corresponding one of anti-toppling boards 8.

Components that are the same as those of the first exemplary embodiment are denoted by the same references and detailed description of the components is omitted here.

As illustrated in FIGS. 9, 10A, and 10B, the booth 1A includes the foundation portion 2 disposed above the installation surface FL, the floor board 3 disposed on the foundation portion 2, the side-wall panel 4 disposed on the foundation portion 2 in an upright manner, the top panel 5 disposed on the side-wall panel 4, four casters 6 disposed at the lower portion of the foundation portion 2, four fasteners 7 disposed at the lower portion of the foundation portion 2 and near the respective casters 6, and the anti-toppling boards 8.

In the booth 1A, the fasteners 7 are disposed on the installation surface FL with a corresponding one of the rectangular anti-toppling boards 8 interposed therebetween and disposed on the right and left sides of the booth 1A. It is difficult to access the fasteners 7 from outside the booth 1A and to adjust the installation height of the booth 1A because each of the fasteners 7, as illustrated in FIG. 12, is installed on the installation surface FL with the corresponding anti-toppling board 8 interposed therebetween in a narrow space (see A in FIG. 12) between the installation surface FL and the foundation portion 2 of the booth 1A.

In the booth 1A according to the present exemplary embodiment, the floor board 3 is unequally divided into two floor boards that are the smaller floor board 31 and the larger floor board 32 arranged in the longitudinal direction of the floor surface. The smaller floor board 31 of the divided floor board 3 is removable.

As illustrated in FIGS. 11A and 11B, the fasteners 7A, 7B, 7C, and 7D become accessible (see arrows in FIGS. 11A and 11B) when the smaller floor board 31 of the floor board 3 divided into two floor boards as described above is removed and the larger floor board 32 is moved to the space created by removing the smaller floor board 31, by a distance of substantially half the length (L/2) of the space in the longitudinal direction of the floor board 3, while the desk 11 and the chair 12 remain placed on the larger floor board 32 as illustrated in FIGS. 11A and 11B.

Thus, even when each of the fasteners 7 is installed on the installation surface FL with the corresponding anti-toppling board 8 interposed therebetween in the narrow space between the installation surface FL and the foundation portion 2 of the booth 1A, the installation height of the booth 1A from the installation surface FL is vertically adjustable by accessing the fasteners 7 from inside the booth 1A and by rotating the adjustment bolts 7*a*.

As in the modifications of the first exemplary embodiment, the floor board 3 is divided, outside the range of motion of the chair 12, into the larger floor board 32A and the smaller floor boards 31A that are triangular, quadrangular, or sectoral at four corners of the floor surface. The smaller floor boards 31A may be removable.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A floor structure for a booth that is installed on an installation surface and that includes a side wall and a door through which a user enters and exits the booth, the floor structure comprising:

a floor surface of a space that is configured to be enclosed by the side wall and in which a desk and chair are placed on the floor surface;

at least one fastener that is configured to fasten the floor surface to the installation surface and that is provided so as to be accessible; and a floor supporting member configured to be protruding inwardly relative to the side wall, wherein the floor supporting member forms a perimeter around an opening and the at least one fastener is configured to be accessible through the opening, wherein the floor surface is unequally divided, outside a range of motion of the chair, into two portions that are a larger portion and a smaller portion arranged in a longitudinal direction of the floor surface, wherein the larger portion of the floor surface supports the chair and the desk, wherein the smaller portion is a portion to be removed, and wherein at least two sides of the larger portion are in contact with and configured to move along the floor supporting member along the longitudinal direction.

2. The floor structure according to claim 1, wherein the smaller portion of the floor surface is configured to be positioned close to the door.

3. The floor structure according to claim 2, wherein the at least one fastener is configured to be at least disposed at a corner of the booth, and the at least one fastener becomes accessible when the larger portion of the floor surface is moved toward a region from which the smaller portion of the floor surface is removed, within a range of up to half a length of the smaller portion of the floor surface in the longitudinal direction of the floor surface.

4. The floor structure according to claim 3, wherein the larger portion of the floor surface is in contact with and supported by the floor supporting member at a position of the larger portion of the floor surface after being moved toward the region from which the smaller portion of the floor surface is removed.

5. The floor structure according to claim 2, further comprising:

a rectangular anti-toppling board, wherein the at least one fastener comprises four fasteners configured to be respectively corresponding to four corners of the booth, and wherein, at two of the four corners of the booth, the corresponding two of the four fasteners are configured to be disposed on the installation surface with the anti-toppling board interposed therebetween.

6. The floor structure according to claim 1, wherein the at least one fastener is configured to be at least disposed at a corner of the booth, and the at least one fastener becomes accessible when the larger portion of the floor surface is moved toward a region from which the smaller portion of the floor surface is removed, within a range of up to half a length of the smaller portion of the floor surface in the longitudinal direction of the floor surface.

7. The floor structure according to claim 6, further comprising:

wherein the larger portion of the floor surface is in contact with and supported by the floor supporting member at a position of the larger portion of the floor surface after being moved toward the region from which the smaller portion of the floor surface is removed.

8. The floor structure according to claim 1, further comprising:

a rectangular anti-toppling board, wherein the at least one fastener comprises four fasteners configured to be respectively corresponding to four corners of the booth, and wherein, at two of the four corners of the booth, the corresponding two of the four fasteners are configured to be disposed on the installation surface with the anti-toppling board interposed therebetween.

* * * * *